United States Patent [19]

Simmons

[11] Patent Number: 4,505,104

[45] Date of Patent: Mar. 19, 1985

[54] TURBINE OVERSPEED LIMITER FOR TURBOMACHINES

[75] Inventor: Roy Simmons, Bristol, England

[73] Assignee: Rolls-Royce Limited, London, England

[21] Appl. No.: 539,380

[22] Filed: Oct. 6, 1983

[30] Foreign Application Priority Data

Oct. 6, 1982 [GB] United Kingdom ..... 8228583

[51] Int. Cl.[3] ..... F02G 3/00; F01B 25/16; F01D 21/00

[52] U.S. Cl. ..... 60/39.091; 415/9

[58] Field of Search ..... 60/39.091; 415/9; 416/247; 74/609

[56] References Cited

U.S. PATENT DOCUMENTS

| | | | |
|---|---|---|---|
| 1,634,897 | 7/1927 | Davis | 415/9 |
| 2,976,012 | 3/1961 | Allen | 415/9 |
| 3,075,741 | 1/1963 | Laubin | 415/9 |
| 3,490,748 | 1/1970 | Hoffman | 415/9 |
| 3,989,407 | 11/1976 | Cunningham | 60/39.091 |
| 4,004,860 | 1/1977 | Gee | 415/9 |

FOREIGN PATENT DOCUMENTS

| | | | |
|---|---|---|---|
| 624166 | 12/1961 | Canada | 415/9 |
| 993711 | 6/1965 | United Kingdom | 415/9 |
| 2002857 | 2/1979 | United Kingdom | 60/39.091 |

*Primary Examiner*—Carlton R. Croyle
*Assistant Examiner*—Jeffrey A. Simenauer
*Attorney, Agent, or Firm*—Parkhurst & Oliff

[57] ABSTRACT

A mechanism 25 for preventing a turbine rotor 14 exceeding a predetermined speed in the event that a shaft 24 connecting the turbine rotor 14 to a compressor rotor 12 of the engine breaks and releases its torsional and axial constraint on the turbine rotor. The mechanism 25 comprises a segmented nozzle guide vane assembly 26 downstream of a stage of the turbine rotor 14. Each of the segments 26 is pivotally mounted (hinge pins 40) on an outer casing 34 at a region adjacent a radially outer upstream end of each segment 26. The structure of the engine on which the radially innermost ends of the segments 26 are mounted includes a releasable means 46. When the structure 46 is struck by the turbine rotor 14 the innermost ends of the segments 26 are released and allowed to swing rearwards and outwards about the pivotal attachment of the segments 26 to the outer casing 34. The upstream outer ends of the segments 26 are retained in the path of rotation of the blades of the turbine rotor 14 so that they collide with the blades and decelerate the turbine rotor 14.

9 Claims, 4 Drawing Figures

TURBINE OVERSPEED LIMITER FOR TURBOMACHINES

Figure 1:
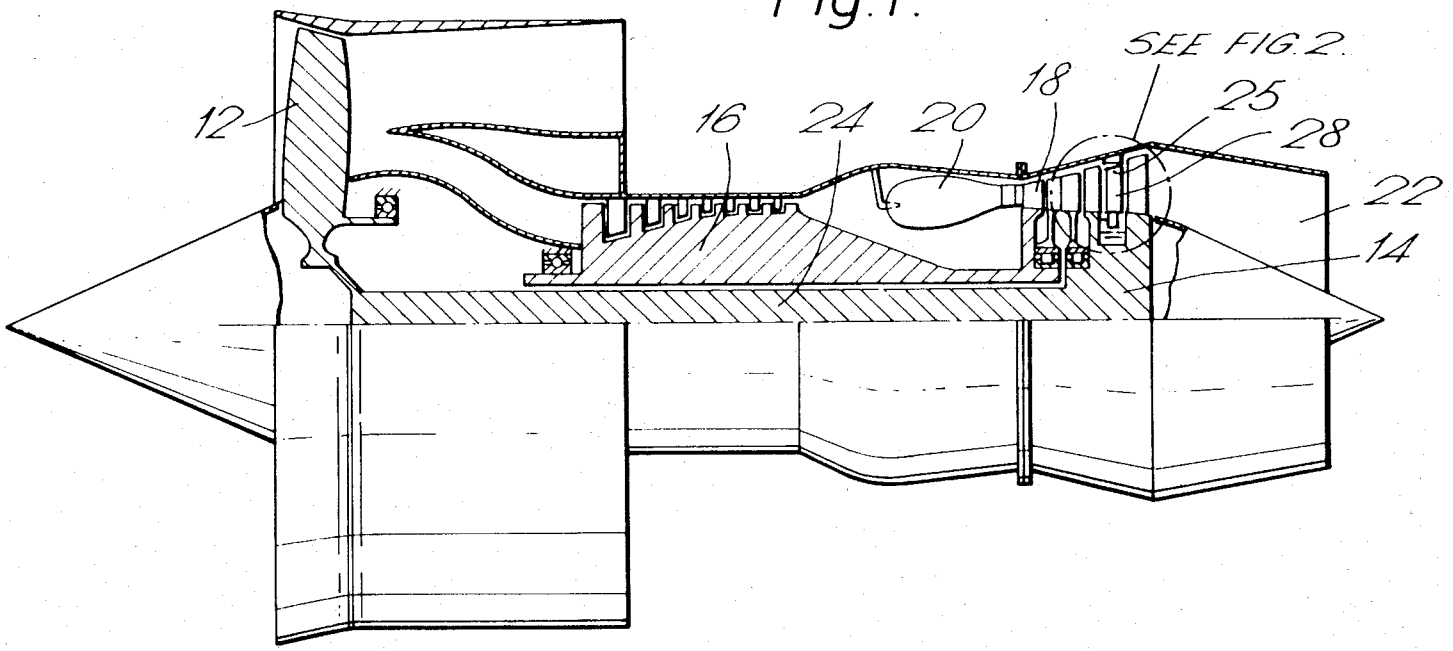

This invention relates to a mechanism for preventing a turbine rotor of a gas turbine engine rotating at an unsafe speed.

A primary requisite in the design of gas turbine engines is that a failure of any component of the engine should not jeopardise the safety of the aircraft to which the engine is fitted, no matter how remote the likeliness of such a failure may be.

This invention addresses itself specifically to the problem of the failure of a shaft which connects a turbine rotor to a compressor or fan rotor.

During normal running the compressor and turbine rotors run at speeds up to predetermined maximum. The aerodynamic forces on the blades of the turbine drive the compressor, and the aerodynamic forces on the compressor oppose the rotation of the turbine rotor. Similarly, the axial load on the turbine is largely balanced by the axial load on the compressor. If a shaft connecting the turbine rotor to the compressor rotor were to break the aerodynamic loads on the turbine rotor accelerate it very rapidly (within a few milliseconds) as there is no opposition provided by the compressor rotor. Consequently, the turbine rotor can accelerate to a speed at which the disc or drum retaining the turbine blades bursts. The blades and disc fragments are then released and subject to an extremely high centrifugal force which can propel them through the engine casings. To provide structure to ensure that in these extreme, and unlikely conditions, all the ejected blades and disc fragments are contained within the engine casings would be very heavy and costly. There is, therefore, a risk that one or more of the blades or disc fragments could damage the aircraft.

The design of the attachments of the compressor rotor to its driving turbine and to the thrust bearing supporting the shaft may be such that if the shaft fails, the turbine rotor is not supported in the thrust bearing but is free to move axially, under the influence of its axial load, and is no longer balanced by the compressor.

It can be shown that simply allowing the rotor to run against a fixed stator structure downstream of the rotor will have no appreciable effect in slowing the rotor down because the heat generated by friction would melt the surfaces of the rotor and the stator vane structures and provide liquid metal lubrication of the rotor for a greater time than it takes for the disc to burst.

The present invention resides in the appreciation that it is possible to design a structure which makes use of the axial movement of the rotor to initiate deceleration of the rotor to safe speeds at which the blades are less likely to be ejected through the engine casings.

An object of this invention is to provide a mechanism for preventing a turbine rotor of a gas turbine engine exceeding a predetermined speed if a shaft, connecting the turbine rotor to a compressor rotor, breaks and releases its torsional and axial constraint on the turbine rotor.

The present invention, as claimed, makes use of the rearwards axial movement of the turbine rotor when the shaft breaks to cause the NGV segments to tilt into the rotor and damage the aerofoil blades of the turbine rotor and thereby diminish their aerodynamic efficiency and decelerate the rotor.

Figure 2:
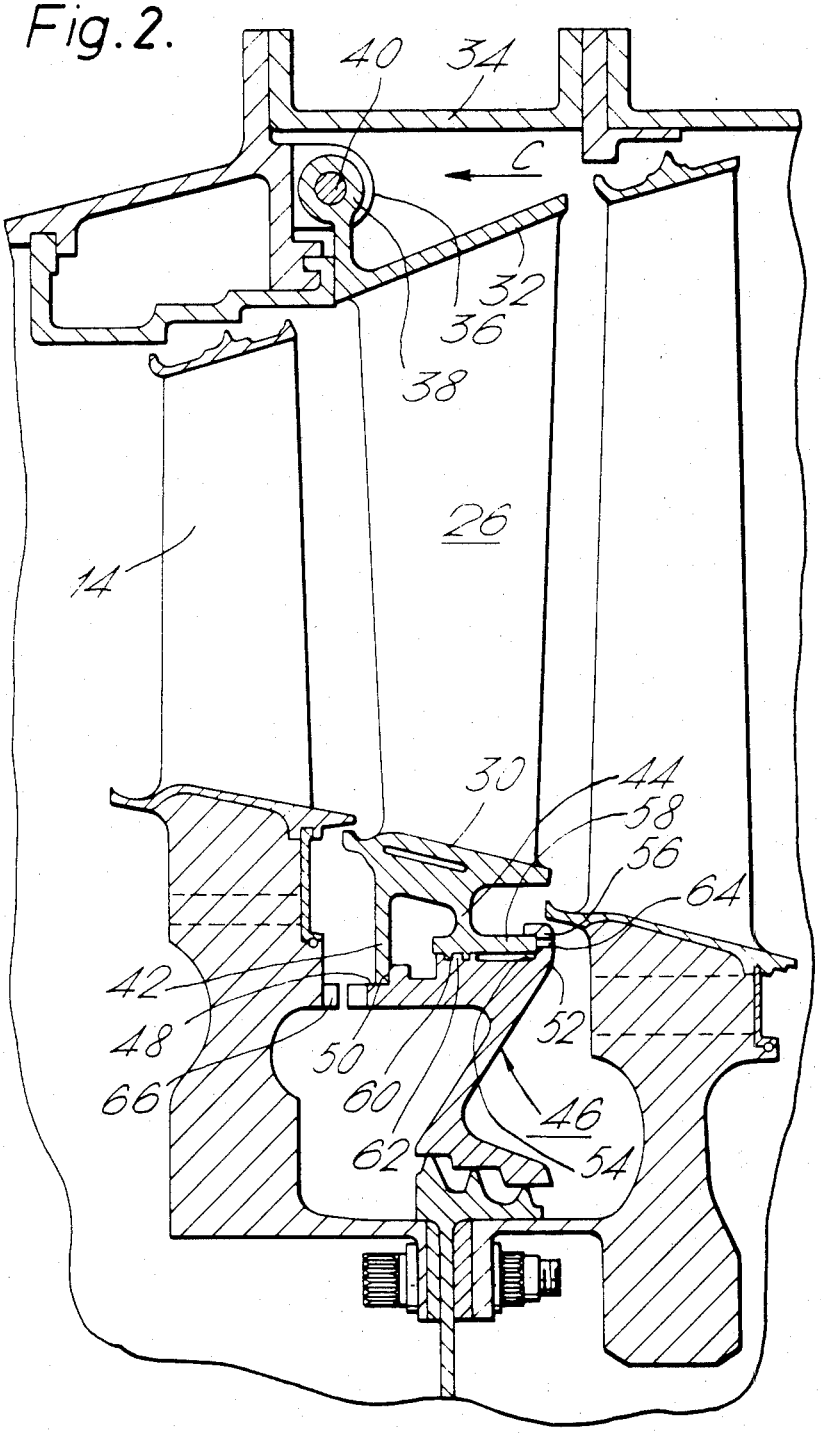
Figure 3:
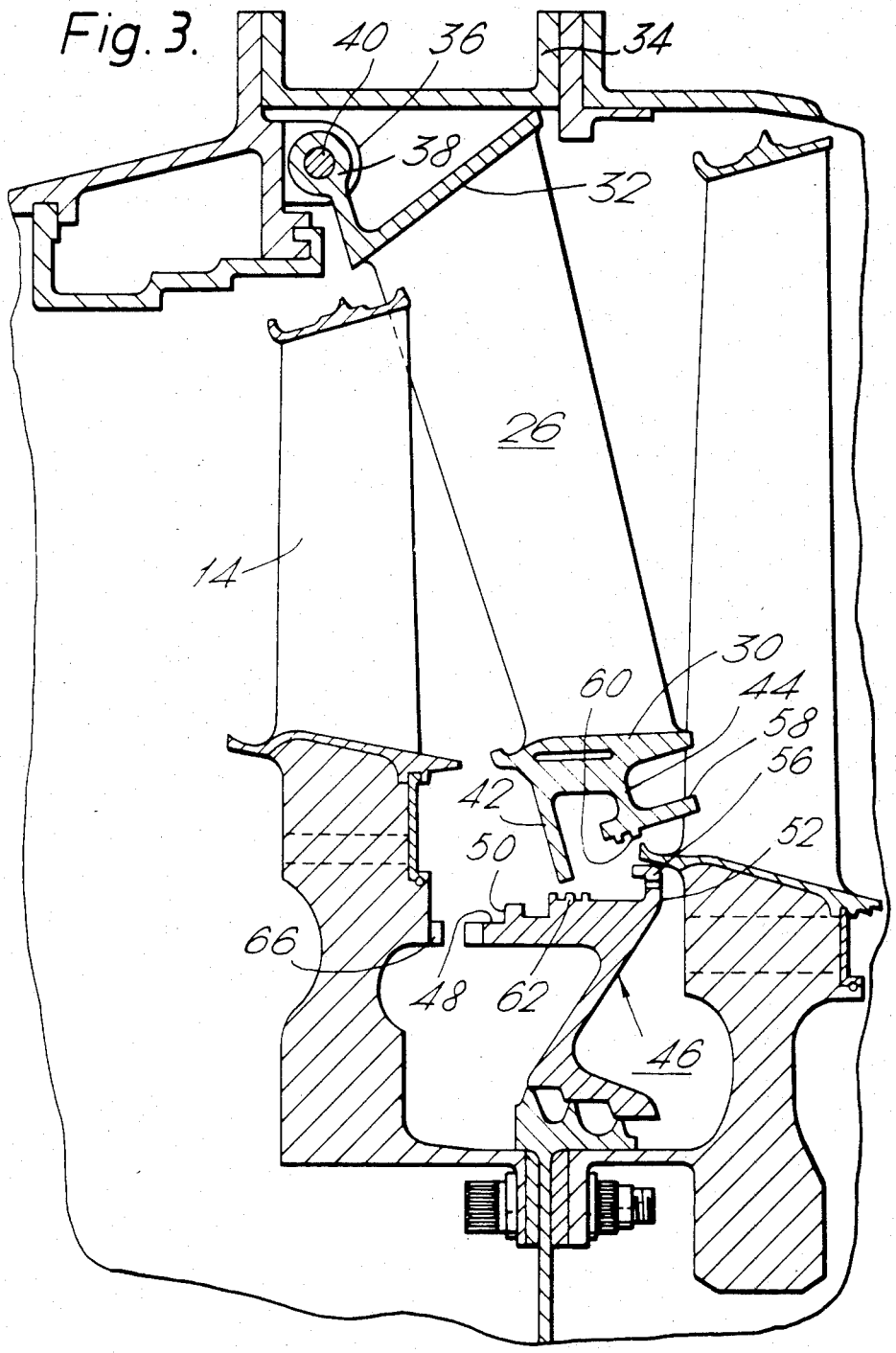
Figure 4:
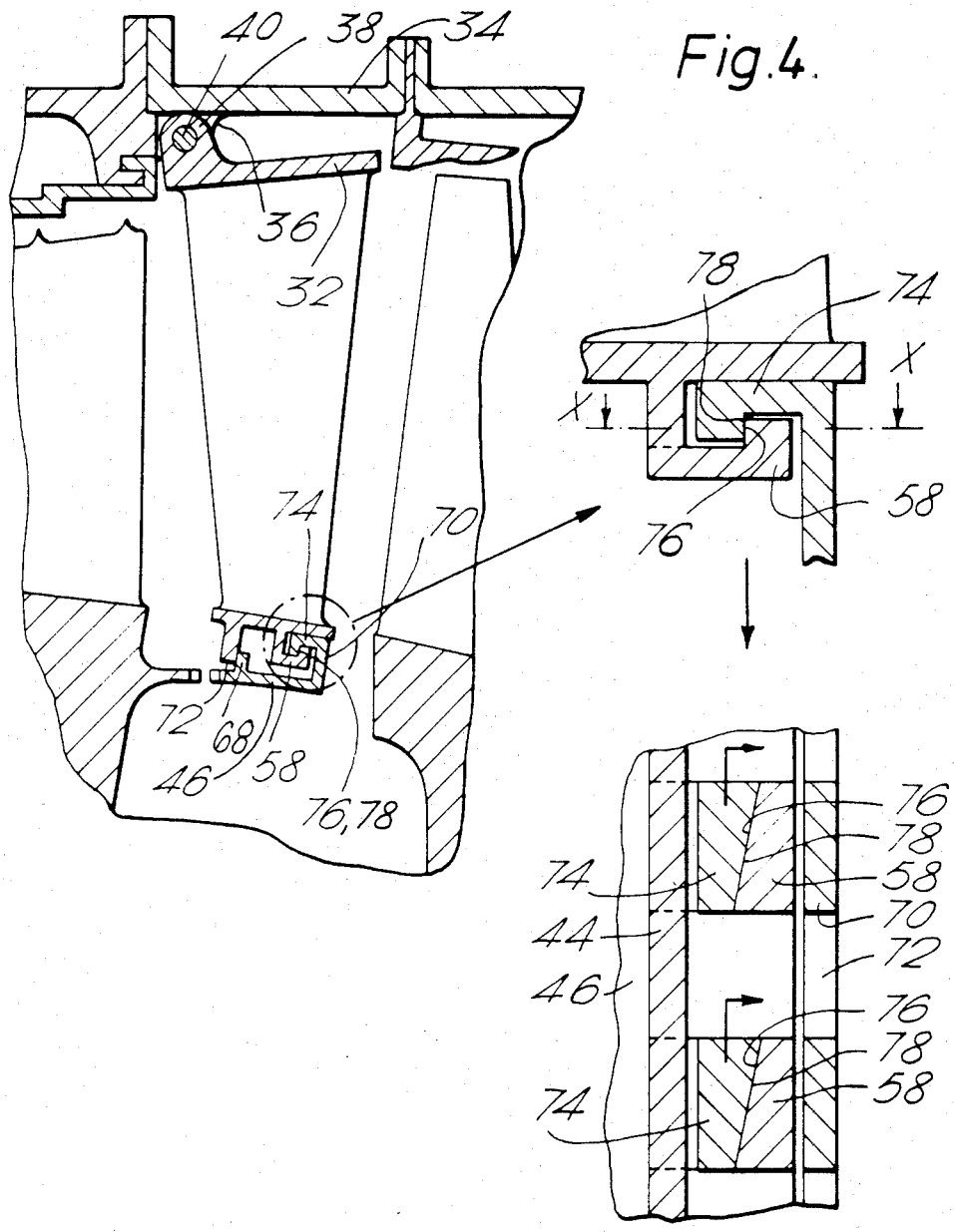

The invention will now be described, by way of an example, with reference to the accompanying drawings in which, FIG. 1 illustrates schematically a gas turbine engine incorporating a mechanism 25 constructed in accordance with the present invention, for preventing a turbine rotor 14 overspeeding if a shaft, connecting the turbine rotor to a compressor rotor, breaks, FIGS. 2 and 3 illustrate schematically a radial cross sectional view through part of the low pressure turbine of the engine of FIG. 1, showing respectively the NGV assembly before and after a shaft failure, and, FIG. 4 illustrates an alternative way of mounting the NGV segments to that shown in FIGS. 2 and 3.

Referring to FIG. 1 there is shown a two spool gas turbine engine of the by-pass type. The engine comprises, a low pressure compressor fan 12 driven by a low pressure turbine 14, a multi-stage axial flow high pressure compressor 16 driven by a high pressure turbine 18, a combustion chamber 20 and a jet pipe 22.

The mechanism for preventing the turbine 14 exceeding a predetermined safe speed if the shaft 24 (which connects the turbine rotor to the compressor 12) breaks is shown by the reference 25. For convenience only the turbine 14 has been shown as incorporating the mechanism but it is to be understood that the turbine 18 could be provided with a similar mechanism.

Referring specifically to FIGS. 2 and 3 there is shown the interstage nozzle guide vane assembly of a two stage turbine 14. As will be seen, the NGV assembly 26 is located on the downstream side of the turbine rotor 14 and comprises a plurality of segments 26 each of which consists of a plurality of stator vanes 28 extending between inner and outer shrouds 30,32.

The turbine outer casing 34 is provided with lugs 36 and each segment 26 is provided with radially outward extending lugs 38. The segments 26 are mounted at their upstream outer ends on hinge pins 40 which are mounted in the lugs 36 and 38.

Each segment 26 is provided at its radially inner end with two axially spaced flanges 42,44, which project radially inwards. The inner ends of the segments 26 are held in place by a releasable means in the form of a locking member 46 which also constitutes the static part of a labyrinth air seal.

The locking member 46 is cylindrical and has at its upstream end a circumferential outer surface that constitutes a radially outward abutment face 48, on which the flanges 42 abut. The locking member 46 has a shoulder which constitutes a forward facing abutment face 50 against which the flanges 42 of the segments 26 bear. The locking member 46 is provided at its downstream end with a radial flange 52 projecting towards the segments 26. The flanges 52 has a recess 54 facing in a forwards direction. The recess defines a hook 56 at the free end of the flanges 52.

The flange 44 of each segment is provided with a cylindrical portion which forms a hook 58 pointing rearwards. The hooks 58 locate in the recess 54. In operation, the gas loads on the NGV segments 26 impose a turning moment which tends to push the flanges 42 radially inwards, and pull the flanges 44 radially outwards. Therefore, the hook 58 on the locking member provide a radially inward facing abutment face 59 and a forward facing abutment face.

The locking member 46 is provided with a plurality of circumferentially spaced helical screw thread forms 60 which face towards the segments 26. The thread forms 60 mesh with complementary shaped thread forms 62 on each of the segments 26. To prevent the locking member 46 rotating relative to the segments 26 by accident, shear pins 64 are provided through the hooks 56 and 58.

The rotor 14 has an engagement means 66 in the form of a plurality of projections or serrations facing towards the NGV assembly 26. The segments 26 are also provided with projections positioned so that if the shaft 24 breaks and the rotor 14 moves rearwards to strike the locking member 46, the engagement means 66 engages the locking member and rotates it relative to the segments 26. This causes the shear pins to fracture and screws the locking member axially rearwards to disengage the hooks 58 from the recess 54. The segments are prevented from rotating relative to the outer casing 34 by the hinge pins 40 and circumferentially spaced dogs on the outer casing.

When the hooks 58 are released the gas loads on the segments 26 cause them to pivot about the hinge pins 40 and thereby swings the inner ends of the segments 26 rearwards and outwards. This opens up a gap between the outer shrouds 32 of the segments. Rearward movement of the rotor causes the tips of the rotor blades to strike the segments and break off. The debris is contained within the outer casing and ejected rearwards down the jet pipe and destroys downstream stages of the turbine.

In addition the rear edge of the radially inner ends of the segments 26 move into the path of the second stage rotor and destroys its aerodynamic efficiency.

Referring now to FIG. 4 the locking member 46 comprises a hollow cylinder with two radial flanges 68, 70 respectively at the upstream and downstream ends of the member 46. The flange 68 forms a forward facing abutment face against which the flanges 42 of the segments bear. A circumferential surface of the member 46 at its upstream end forms a radially outward facing abutment surface 72 on which the flanges 42 of the segments bear.

The rear flange 70 is slotted (slots 72) and provided with a inward facing recess so that the flange 70 effectively forms a plurality of spaced hooks 74 which impose an inwards and rearwards constraint on the hooks 58 of the segments 26. The confronting faces 76,78 of the hooks 58,74 lie in helical planes so as to form a course screw thread.

In operation, when the rotor strikes the locking member 46 the locking member is rotated so that the hooks 58 move into the spaces between the hooks 74 and allow the locking member 46 to be pushed axially. This releases the hooks 58 allowing the segments to swing about the hinge pins as described above in connection with FIGS. 2 and 3. Shear pins 80 are provided to prevent the locking member 46 rotating unintentionally until it is struck by the rotor.

I claim:

1. A mechanism for preventing a turbine rotor of an engine exceeding a predetermined speed in the event that a shaft connecting the turbine rotor to a compressor rotor of the engine breaks and releases its torsional and axial constraint on the turbine rotor, the mechanism comprising a segmented nozzle guide vane stator assembly downstream of a stage of the turbine rotor, said rotor having blades, each of the segments being pivotally mounted on an outer casing at a region adjacent a radially outer upstream end of each segment, and static structure of the engine on which the radially innermost ends of the segments are mounted, the structure including a releasable means which when the structure is struck by the turbine rotor is operable to release the innermost ends of the segments and allow them to swing rearwards and outwards about the pivotal attachment of the segments to the outer casing whilst retaining the upstream outer ends of the segments in the path of rotation of the blades of the turbine rotor so that they collide with the blades and decelerate the turbine rotor.

2. A mechanism according to claim 1 wherein the releasable means comprises a locking member which in a first position secures the inner ends of the segments, and the turbine rotor is provided with a device that co-operates with the locking member when the turbine rotor moves rearwards to move the locking member to a second position to release the inner ends of the segments.

3. A mechanism according to claim 2 wherein the locking member is provided with a forward facing abutment surface and each segment is provided with a rearward facing abutment surface which engages the abutment surface of the locking member.

4. A mechanism according to claim 2 wherein the locking member is rotatably mounted so that it is rotated from said first position to said second position and the rotor is provided with engagement means for engaging the locking member and rotating it to the second position, and means are provided to prevent the locking member unintentionally rotating to said second position.

5. A mechanism according to claim 4 wherein the engagement means that co-operate with the locking member to move the locking member is a serrated face on the turbine which faces towards the locking member and the locking member has a serrated face confronting that on the turbine rotor.

6. A mechanism according to claim 4 wherein the means for preventing the locking member rotating unintentionally is one or more shear pins designed to shear when the turbine rotor strikes the locking member in the event of the shaft breaking.

7. A mechanism according to claim 2 wherein each segment is provided with a helical thread form facing the locking member, the locking member is provided with a helical thread form that meshes with the thread form on each segment and a stop means is provided to restrict the torsional movement of each segment about the axis of rotation of the turbine rotor, and the thread forms are arranged so that rotation of the locking member from the first position to the second position advances it axially rearwards along the thread forms of the segments and thereby disengages the hooks from the locking member.

8. A mechanism according to claim 2 wherein the stator vane assembly is provided with a plurality of circumferentially spaced hooks, and each segment has at least one hook, the locking member has a plurality of circumferentially spaced recesses in which each hook engages so that in said first position of the locking member the locking member provides a radially inwards and axially forwards constraint on the inner ends of each segment, the regions of the locking member circumferentially between the said recesses being constructed so that when the locking member is rotated about it's axis of rotation to the second position as a consequence of the turbine rotor moving rearwards and striking the locking member, the hooks are disengaged from the recesses and the radial and axial constraint on the inner ends of the segments is released.

9. A mechanism according to claim 8 wherein the hooks are provided at the free ends of flanges that project radially inwards from the downstream region of the inner ends of the segments of the stator vane assembly and are defined by segments of a hollow cylinder extending in an axial direction and a radially outward facing first groove, the recesses in the locking member are constituted by a radially inward facing second groove in the inner circumferential wall of circumferentially spaced segments of a hollow cylinder at the free end of a radially outward projecting flange of the locking member, and in the first position of the locking member a side wall of the first groove contacts a side wall of the second groove.

* * * * *